United States Patent [19]

Barnett

[11] 4,050,970

[45] Sept. 27, 1977

[54] STABILIZED NITRATO-ALKANOL EXPLOSIVE COMPOSITION

[75] Inventor: George Henry Barnett, Kew, Australia

[73] Assignee: ICI Australia Limited, Melbourne, Australia

[21] Appl. No.: 634,179

[22] Filed: Nov. 21, 1975

[30] Foreign Application Priority Data

Dec. 9, 1974 Australia ..... 9949/74

[51] Int. Cl.[2] ..... C06B 25/00

[52] U.S. Cl. ..... 149/88; 260/467

[58] Field of Search ..... 260/553, 564, 467; 149/88

[56] References Cited

U.S. PATENT DOCUMENTS 3,904,452 9/1975 Fossan et al. ..... 149/88 X

*Primary Examiner*—Stephen J. Lechert, Jr,

*Attorney, Agent, or Firm*—Cushman, Darby & Cushman

[57] ABSTRACT

A composition of matter comprising at least one nitrato-alkanol and a stabilizingly effective amount of one or more derivatives of carbamic acid. The composition is useful as a component of explosive compositions.

19 Claims, No Drawings

STABILIZED NITRATO-ALKANOL EXPLOSIVE COMPOSITION

This invention relates to compositions of matter comprising nitrato-alkanols. More particularly the invention relates to compositions comprising nitrato-alkanols and containing materials which are capable of lessening the rate of decomposition of the nitrato-alkanol component thereof. The invention also describes useful products containing such compositions and processes for their manufacture.

In U.S. Pat. No. 3,653,992 it has been proposed to use nitrato-alkanols as sensitizers in explosive compositions of the aqueous slurry type. In U.S. Pat. No. 3,653,992 a preferred manufacturing procedure results in the formation of the nitrato-alkanol in situ in the composition and such a procedure is commendable with the proviso that the raw materials used to form the nitrato-alkanol are readily available at the site at which the composition is to be made. However it was appreciated in U.S. Pat. No. 3,653,992 that under certain circumstances it may be necessary to manufacture the nitrato-alkanol component separately and to incorporate it into the composition by mixing it with other ingredients, and such a teaching is set out in U.S. Pat. No. 3,653,992. The need to manufacture a separate nitrato-alkanol component may be dictated by a variety of circumstances; for example Government regulations relating to the transport of explosive compositions, or the supply of the sensitizing material from a country capable of manufacturing it to another country dificient in the required technology or in suitable raw materials, or the favourable economics resultant from the manufacture of the sensitizing material at one site followed by the transport thereof to another less industrialized and often remote site within a single country. It has been observed that compositions comprising nitrato-alkanols are prone to decomposition with the generation of a component which tends to lower the pH of the composition. The rate of decomposition is comparatively slow whilst the pH of the composition is higher than 4, but at pH values below 4 such a rate increases. The decomposition rate is also accelerated by increase in temperature. Therefore the transport of nitrato-alkanol compositions in tropical areas, whereby sun temperatures of up to 80° C may be encountered, poses a problem relating to loss of the nitrato-alkanol component of the compositions. Since explosive compositions comprising nitrato-alkanols are highly efficacious and since it is not always possible to generate nitrato-alkanols in situ in such compositions it is highly desirable that there be found compositions of matter comprising one or more nitato-alkanols which are less prone to decomposition than the nitrato-alkanol compositions of the prior art and thereby facilitate their transport and handling.

We have now found that the rate and degree of decomposition of compositions comprising nitrato-alkanols may be reduced if there is incorporated into such compositions an amount of material derived from carbamic acid.

Accordingly we provide a composition of matter comprising at least one nitrato-alkanol and a stabilizingly effective amount of one or more derivatives of carbamic acid.

Examples of nitrato-alkanols which may be present in our compositions include mononitrato-alkanols such as 1-hydroxy-2-propylnitrate, 2-hydroxy-1-propylnitrate, 3-chloro-1hydroxy-2-propylnitrate, 3-chloro-2-hydroxy-1-propylnitrate, glycerol-1-mononitrate, glycerol-2-mononitrate, propylene glycol mononitrate and especially ethylene glycol mononitrate. Our compositions may also contain dinitrato-alkanols such as glycerol dinitrate. It will be appreciated that in addition to nitrato-alkanols other materials may also be present in our compositions. Thus for example in the instance wherein ethylene glycol mononitrate is the nitrato-alkanol to be stabilized there may also be present water, inorganic salts such as ammonium nitrate or organic materials such as ethylene glycol.

The nature of the derivative of carbamic acid in our compositions may take several forms. Thus we have found that salts, esters and amides thereof are effective as stabilizers for nitrato-alkanols. As typical examples of such derivatives there may be mentioned ammonium carbamate and mixtures thereof with ammonium carbonate and/or ammonium bicarbonate, the ethyl ester of carbamic acid which is commonly referred to as urethane, and the methyl and propyl esters of carbamic acid. Other useful derivatives include those containing a metal ion. Thus when it is desirable to arrest the decomposition of a nitrato-alkanol solution rapidly it is sometimes useful to include in the stabilizing component a derivative of carbamic acid which decomposes comparatively rapidly in the solution. A typical example of such a derivative is a nitrile derivative such as a metallic cyanamide like calcium cyanamide. It is often convenient to use such a derivative in conjunction with one or more other derivatives which have a more prolonged stabilizing effect. Other useful metal containing derivatives include those described in British patent specification No. 1,168,092 wherein there is set out compositions made by heating urea with a carbonic salt of alkali metals such as sodium or potassium bicarbonate. Such carbamic powders are available commerically under the Registered Trade name of "Monnex". Other suitable derivatives are those emanating from the amide of carbamic acid and examples of these compounds include methylolureas such as NN'-dimethylolurea or 1-hydroxymethylurea; the alkylated ureas for example 1-methylurea, 1-ethylurea, 1-butylurea, 1,3-dimethylurea, 1,1-diethylurea or 1,3-diethylurea; and isourea. The amide itself, commonly referred to as urea, is particularly useful and is a preferred stabilizing material.

The mechanism whereby the rate and degree of decomposition of compositions comprising nitrato-alkanols is reduced by treating such compositions with derivatives of carbamic acid is not clearly understood. It would seem that the stabilizing action is not related to the conventional stabilizing action which occurs when nitroglycerine is stabilized by means of diphenylamine and derivatives thereof such as diphenylureas since we have found that the addition of diphenylamine to a solution of a nitrato alkanol discolors the nitrato alkanol and promotes its decomposition rather than stabilizing it. Whilst we do not wish to be limited by theoretical considerations it would seem that the mechanism is related in some manner to the capability of the stabilizing material to act as a source for the production of cyanic acid and that the cyanic acid should be converted in acidic solution to an ammonium ion at a rate which is sufficient to react with the major proportion of the decomposition products of the nitrato alkanol as they are generated. Thus for example whilst urea is a typical example of a satisfactory stabilizing material, the more stable biuret is not satisfactory. We have also found that thiourea, which does not decompose is a manner as outlined above, is not a satisfactory stabilizing material.

We also provide a process for stabilizing a composition comprising at least one nitrato-alkanol which process comprises incorporating into and admixing with said composition a stabilizingly effective amount of at least one derivative of carbamic acid. Our process of stabilizing the composition may be performed in several ways. Thus by the use of conventional mixing means the desired amount of stabilizing material may be incorporated uniformly e.g. dissolved, into the composition. Alternatively the stabilizing material may be added in aliquots over a period of time; such a procedure is efficacious in the instance where, for example, the composition is being transported over prolonged distances in a tanker provided with mixing means and wherein a range of sun temperatures are encountered. Yet again the stabilizing component may be added to the composition in an encapsulated form, such as in capsules of the slow release type, whereby by suitable choice of the material from which the capsule is made, addition of the stabilizer to the composition may be made at desired time intervals. Still further an inert material may be used to act as a carrier or adsorbant for the stabilizing material. Thus for example mixtures of urea and woodmeal may be used for such a purpose.

The amount of stabilizing material in our compositions is dependent to some extent on the nature of the nitrato-alkanol to be stabilized, and also on the range of temperatures. Thus it is apparent that for a desired degree of stabilization there is a need to increase the amount of the stabilizing component as the temperature of the composition is increased since the rate of decomposition increases dramatically as the temperature of the composition is increased. This aspect may be exemplified by reference to an aqueous solution containing ethylene glycol mononitrate and having a pH of 7. When such a solution was stored at 40° C, the decomposition rate was such that pH of the solution did not fall below 4 until 35 days had elapsed, whereas when the storage remperature was raised to 60° C and 70° C a similar change in pH occurred in 2½ days and 1 day respectively. For most practical purposes was have found that effective stabilization of compositions comprising nitrato-alkanols may be achieved at temperatures of up to 80° C by incorporating into the composition one or more carbamic acid derivatives in amounts such that they constitute up to 10% w/w of the stabilized compositions, although amounts greater than this value may be used if desired. The amount of stabilizing material used is also dependent on the nature of the stabilizer. Thus for example where a composition comprising ethylene glycol mononitrate is stabilized by means of urea, amounts of urea which constitute from 1 to 10% w/w, preferably from 2 to 5% w/w of the stabilized composition has been found to be useful in retarding the rate of decomposition of the nitrato-alkanol at elevated temperatures. The amount of stabilizer used should not cause decomposition of the composition to be stabilized; preferably the amount of stabilizer used should be such that the pH of the freshly stabilized solution is not higher than about 8. It is preferred that the stabilizer be soluble in the composition to be stabilized at the concentration at which it is used, although stabilizers which do not meet this criterion may also be used.

The stabilized compositions of the invention are useful as sensitizer components in explosive compositions of the aqueous slurry type. Such compositions comprise in general terms one or more inorganic oxygen releasing salts, water, and sensitizer components, often with a thickener and one or more supplemental fuel and energizing ingredients and such compositions have had extensive use in recent years. The nature of the components and their proportions in such compositions is well known to those skilled in the art. Thus for example the oxygen releasing salts are usually nitrates, chlorates or perchlorates of alkali metals, alkaline earth metals or ammonium and usually constitute from 50 to 90% w/w, very often from 65 to 85% w/w of the explosive composition. The water content may be as high as 35% w/w of the composition and amounts in the range from 5 to 25% w/w, say from 10 to 20% w/w, are commonly used. Thickeners are usually selected from amongst natural or synthetic gums of the polysaccharide type and of these guar gum or biopolymeric materials derived from carbohydrates are the most common. Optionally such thickeners may be crosslinked. From amongst supplemental fuels and energizers there may be mentioned for example glycols, sugar, molasses, starch and metals such as aluminium.

Accordingly in an embodiment of our invention we provide in an explosive composition of the aqueous slurry type comprising one or more inorganic oxygen releasing salts, water and a sensitizer component the said sensitizer component being present in sensitizing amount and being soluble and dissolved in the aqueous phase of the said explosive compositions, the improvement wherein the said sensitizer component is a composition of matter comprising at least one nitrato-alkanol and a stabilizingly effective amount of a derivative of carbamic acid. Typical sensitizer components include compositions containing ethylene glycol mononitrate stabilized with from 1 to 10% of its weight of urea.

The amount of sensitizer component in the explosive compositions referred to above may be varied to suit the degree of sensitivity desired in the composition. The amount of the sensitizer component can be as low as to constitute about 1% w/w of the finished explosive, often in the range from 5 to 75% w/w and usually not exceeding about 50% w/w. In preferred practice the sensitizer component comprises a stabilized composition containing ethylene glycol mononitrate and in an amount as to constitute from about 1 to 50% w/w, more preferably from about 5 to 25% w/w, of the finished explosive although proportions outside that range are often advantageously utilized.

Apart from the stabilized sensitizer component the explosive compositions derived from our invention are similar to the nitrato-alkanol sensitized explosive compositions of the prior art. When freshly prepared the sensitivity to detonation imparted by a given proportion of nitrato-alkanol is similar when our compositions and those of the prior art are compared. However subsequent to storage under temperature conditions likely to be encountered in tropical regions we have found that the diminution in sensitivity to detonation is less in the instance of the compositions of the invention than with similar compositions of the prior art wherein the sensitizer component does not contain a stabilizing ingredient.

The explosive compositions derived from the invention can be prepared in accordance with any suitable procedure. Thus as an example of a suitable procedure an aqueous solution phase is first formed from the oxidizer salt, the stabilized nitrato-alkanol compositions and the water component, followed by addition of the remaining ingredients in any suitable sequence, any thickener and/or aeration agent often being last added.

Whilst reference has been made hereinbefore to the use of nitrato-alkanols as sensitizing agents in explosive compositions, it will be appreciated that nitrato-alkanols also serve other useful purposes in such compositions. Thus it is known that nitrato-alkanols may also be used as a fuel material or fluidizer component of an explosive composition. The efficacy with which nitrato-alkanols act in these capacities is of course related to the amount of nitrato-alkanol present in the composition at a particular time. With the propensity of nitrato-alkanols to decompose it is clearly advantageous to minimize the rate of such decomposition so as to maintain over a period of time the characteristics of the explosive composition to values as close as possible to the original values. The incorporation of the stabilized compositions of our invention into explosive compositions which hitherto have contained unstabilized nitrato-alkanols as components provides a means whereby the rate of reduction of desired characteristic values, such as for example explosive power or fluidity, of the explosive compositions can be minimized over a period of time.

The invention is advantageous in that it has provided a means whereby hazards relating to the use and transport of nitrato-alkanols may be reduced. It has also provided a means whereby explosive compositions having enhanced stability characteristics may be prepared from compositions comprising nitrato-alkanols such as compositions wherein the nitrato-alkanol content is as high as 90% w/w. It has also provided a means whereby explosive compositions having improved sensitivity to detonation characteristics after storage may be obtained thus ensuring that blasting operations wherein such compositions are used may be performed more effectively and with more reliability than has been possible with similar unstabilized compositions of the prior art. Since the stabilized compositions are less prone to produce acidic by-products or produce them at a lower rate than unstabilized compositions comprising nitrato-alkanols, our invention has provided advantageously a means whereby corrosion of containers, pipelines and the like with which the compositions may be in contact is reduced.

Our invention is now illustrated by, but is not limited to, the following examples wherein all parts and percentages are expressed on a weight basis unless otherwise specified. Examples 1 to 4 inclusive and 16 to 18 inclusive are included for the purposes of comparison and do not form part of our invention.

In the following examples 1 to 19 a stock solution was prepared as set out below and 100 parts thereof was used in each of Examples 1 to 19. There was added to this 100 parts of stock solution, the amounts of stabilizing material as set out in Table 1. The resultant mixture was stirred to provide a uniform composition and this composition was then stored for the time and at the temperature set out in Table 1. During the storage period the pH of the composition was determined at intervals and the time taken for the pH to fall below a value of 4 and also to reach a value of 1 were recorded. The time taken for these conditions of pH to be achieved was taken as a measured of the rate of decomposition of the nitrato-alkanol present in the compositions. Thus the shorter the time taken to reach the designated conditions of pH, the more prone was the composition to decompose under the designated conditions of storage. It will be observed by reference to comparative Examples 1 to 4 that the rate of decomposition of the compositions of those Examples at temperatures of 40° C and below was low in comparison with the decomposition rate at 60° C and 70° C. Accordingly no tests were made at storage temperatures below 60° C using compositions according to the invention.

The stock solution referred to above was prepared by conventional means whereby vapourous ethylene oxide was reacted with a stoichiometric excess of nitric acid in an aqueous medium and the excess acid was neutralized with ammonia. The stock solution so obtained had a pH of 7 and was suitable to be used as portion of an explosive composition of the aqueous slurry type since it contained:

175 parts of water,
496 parts of ethylene glycol mononitrate useful as a sensitizing component,
253 parts of ammonium nitrate useful as an oxidizer salt component and
48 parts of ethylene glycol useful as a fuel component per 972 parts of the stock solution.

TABLE 1

| Example No. | Parts & name of stabilizer | Temperature of storage (° C) | Days required for pH of composition to fall below 4 | Days required for pH of composition to fall to 1 |
|---|---|---|---|---|
| 1 | None | 70 | 1 | 1½ |
| 2 | None | 60 | 2½ | 6 |
| 3 | None | 40 | 35 | Greater than 44 |
| 4 | None | 28 | Greater than 44 | Not determined |
| 5 | 0.5 Urethane | 70 | 1½ | 4 |
| 6 | 0.5 Urethane | 60 | 3 | 8 |
| 7 | 1 Urea | 70 | 2½ | 14 |
| 8 | 1 Urea | 60 | 4 | Greater than 32 |
| 9 | 2 Urea | 70 | 17 | Not determined |
| 10 | 2 Urea | 60 | 25 | Not determined |
| 11 | 5 Urea | 70 | 36 | Not determined |
| 12 | 5 Urea | 60 | 56 | Not determined |
| 13 | 1 Urea (admixed with 0.2 part of woodmeal) | 70 | 3 | 21 |
| 14 | 0.5 Urethane admixed with 0.5 urea | 60 | 4 | 24 |

TABLE 1-continued

| Example No. | Parts & name of stabilizer | Temperature of storage (° C) | Days required for pH of composition to fall below 4 | Days required for pH of composition to fall to 1 |
|---|---|---|---|---|
| 15 | 5 commercially available ammonium carbamate (containing ammonium bicarbonate) | 60 | 6 | 9 |
| 16 | 5 Biuret | 70 | 1 | Not determined |
| 17 | 5 Biuret | 60 | 2½ | Not determined |
| 18 | 0.5 Diphenylamine | 70 | * | Not determined |
| 19 | 7 Urea | 60 | Greater than 56 | Not determined |

EXAMPLE 20

Into 260 parts of the stock solution used in Examples 1 to 19 inclusive was admixed 3 parts of urea and to the resultant stabilized solution there was added:

Ammonium nitrate: 500 parts
Sodium nitrate: 145 parts
Nitrocotton (containing 30% water): 25 parts
Woodmeal: 15 parts
Aluminium powder: 40 parts The resultant mixture was blended to a uniform mixture and there was then dispersed into the mixture 10 parts of guar gum followed by 5 parts of borax and 0.2 part of zinc chromate. There was thus obtained an explosive composition of the aqueous slurry type which was packaged into cylindrical containers which were 8 inches long and had a diameter of 1¼ inches. The explosive cartridges so prepared were detonated using a No. 6 copper detonator and had a velocity of detonation of 3.3 kilo meters per second.

I claim:

1. An aqueous composition of matter comprising at least one nitrato-alkanol and a stabilizingly effective amount of one or more derivatives of carbamic acid sufficient to maintain the pH of said aqueous composition between about 4 and about 8.

2. A composition according to claim 1 wherein the said nitrato-alkanol is selected from the group consisting of hydroxy-alkyl nitrates, chlorohydroxyalkyl nitrates, glycerol mononitrates and alkylene glycol mononitrates.

3. A composition according to claim 1 wherein the said nitrato-alkanol is selected from the group consisting of 1-hydroxy-2-propylnitrate, 2-hydroxy-1-propylnitrate, 3-chloro-1-hydroxy-2-propylnitrate and 3-chloro-2-hydroxy-1-propylnitrate.

4. A composition according to claim 1 wherein the said nitrato-alkanol is propylene glycol mononitrate.

5. A composition according to claim 1 wherein the said nitrato-alkanol is ethylene glycol mononitrate.

6. A composition according to claim 1 wherein the said derivative of carbamic acid constitutes up to 10% w/w of the said composition.

7. A composition according to claim 1 wherein said derivative of carbamic acid is a salt, ester or nitrile derivative of carbamic acid.

8. A composition according to claim 1 wherein said derivative of carbamic acid is an amide of carbamic acid or a derivative thereof.

9. A composition according to claim 8 wherein said derivative of carbamic acid is urea.

10. A composition according to claim 8 wherein said derivative of carbamic acid is selected from the group consisting of methylolureas, alkylated ureas and isourea.

11. A composition according to claim 8 wherein said derivative of carbamic acid comprises the reaction product made by heating urea with a carbonic salt of an alkali metal.

12. A composition according to claim 11 wherein the said salt is selected from the group consisting of potassium bicarbonate and sodium bicarbonate.

13. A composition according to claim 7 wherein said salt of carbamic acid is ammonium carbamate.

14. A composition according to claim 7 wherein said ester of carbamic acid is the ethyl ester.

15. A process of stabilizing a composition comprising at least one nitrato-alkanol which process comprises incorporating into and admixing with said composition a stabilizingly effective amount of at least one derivative of carbamic acid.

16. A process according to claim 15 which process comprises incorporating and admixing with said composition up to 10% w/w of said composition of a salt, ester or nitrile derivative of carbamic acid.

17. A process according to claim 15 which process comprises incorporating and admixing with said composition from 1 to 10% w/w of said composition of an amide of carbamic acid or a derivative thereof.

18. A process according to claim 15 which process comprises incorporating and admixing with said composition from 2 to 5% w/w of said composition of urea.

19. A process according to claim 15 wherein the said nitrato-alkanol is ethylene glycol mononitrate.

* * * * *